US010522311B2

(12) United States Patent
Kitagawa

(10) Patent No.: US 10,522,311 B2
(45) Date of Patent: Dec. 31, 2019

(54) RELAY

(71) Applicant: OMRON Corporation, Kyoto-shi, Kyoto (JP)

(72) Inventor: Tatsuro Kitagawa, Koshi (JP)

(73) Assignee: OMRON Corporation, Kyoto-shi (JP)

( * ) Notice: Subject to any disclaimer, the term of this patent is extended or adjusted under 35 U.S.C. 154(b) by 188 days.

(21) Appl. No.: 15/686,191

(22) Filed: Aug. 25, 2017

(65) Prior Publication Data

US 2017/0352511 A1 Dec. 7, 2017

Related U.S. Application Data

(63) Continuation of application No. PCT/JP2015/078086, filed on Oct. 2, 2015.

(30) Foreign Application Priority Data

Mar. 11, 2015 (JP) ..... 2015-048580

(51) Int. Cl.
*H01H 50/24* (2006.01)
*H01H 50/04* (2006.01)
(Continued)

(52) U.S. Cl.
CPC ..... *H01H 50/04* (2013.01); *H01H 50/24* (2013.01); *H01H 50/36* (2013.01); *H01H 50/56* (2013.01); *H01H 50/64* (2013.01)

(58) Field of Classification Search
CPC ..... H01H 50/24; H01H 50/643
See application file for complete search history.

(56) References Cited

U.S. PATENT DOCUMENTS 3,544,930 A 12/1970 Sauer
3,889,087 A 6/1975 Graeff
(Continued)

FOREIGN PATENT DOCUMENTS

CN 1141496 A 1/1997
JP S55-037759 A 3/1980
(Continued)

OTHER PUBLICATIONS

An English translation of a Written Opinion in an International Application No. PCT/JP2015/078086 dated Dec. 22, 2015 from the International Searching Authority.
(Continued)

*Primary Examiner* — Ramon M Barrera
(74) *Attorney, Agent, or Firm* — Metrolex IP Law Group, PLLC

(57) ABSTRACT

A movable member is configured to switch, by rotation, between a first state and a second state. In the first state, the movable member presses a plurality of first movable contact pieces to bring first contacts into contact with first substrate side contact points. When the movable member is in the second state, the first contacts are separated from the first substrate side contact points. A coil block includes a coil and causes the movable member to rotate by electromagnetic force generated by energization of the coil. A rotation axis of the movable member is parallel to an axis of the coil. The plurality of first substrate side contact points is arranged side by side in an axial direction of the coil on a first base substrate. The plurality of first movable contact pieces is arranged side by side in the axial direction.

12 Claims, 17 Drawing Sheets

(51) Int. Cl.

| | |
|---|---|
| ***H01H 50/56*** | (2006.01) |
| ***H01H 50/64*** | (2006.01) |
| ***H01H 50/36*** | (2006.01) |

(56) References Cited

U.S. PATENT DOCUMENTS

| | | | |
|---|---|---|---|
| 4,292,613 | A | 9/1981 | Bando et al. |
| 5,696,475 | A | 12/1997 | Yoshitani et al. |

FOREIGN PATENT DOCUMENTS

| | | | |
|---|---|---|---|
| JP | S57-015058 | U | 1/1982 |
| JP | H08-250003 | A | 9/1996 |
| JP | 2005-071815 | A | 3/2005 |

OTHER PUBLICATIONS

The International Search Report of PCT/JP2015/078086 dated Dec. 22, 2015.

The Chinese office action dated Jul. 4, 2018, in a counterpart Chinese patent application.

RELAY

CROSS REFERENCE TO RELATED APPLICATIONS

This application is a continuation application of International Application No. PCT/JP2015/078086, filed on Oct. 2, 2015, which claims priority based on the Article 8 of Patent Cooperation Treaty from prior Japanese Patent Application No. 2015-048580, filed on Mar. 11, 2015, the entire contents of which are incorporated herein by reference.

TECHNICAL FIELD

The disclosure relates to a relay.

BACKGROUND ART

A relay includes a coil and an armature. The armature operates by electromagnetic force generated by energization of the coil. This causes a movable contact and a fixed contact provided in the armature to be switched between ON and OFF.

For example, in a relay of Patent Document 1, an armature is oscillatably supported, and movable touch pieces are attached to both ends of the armature. Oscillation of the armature by electromagnetic force of the coil causes the movable touch pieces to move. This causes contacts to be switched between ON and OFF.

In addition, in a relay of Patent Document 2, an armature is coupled to movable touch pieces via a link member. When the armature rotates by electromagnetic force of a coil, rotational movement of the armature is converted into linear movement via the link member and transmitted to the movable touch pieces. This causes contacts to be switched between ON and OFF.

PRIOR ART DOCUMENTS

Patent Documents

Patent Document 1: Japanese Unexamined Patent Publication No. H08-250003

Patent Document 2: Japanese Unexamined Patent Publication No. 2005-71815

SUMMARY OF THE INVENTION

Problems to be Solved by the Invention

In the above-described relay, in order to increase the number of contact poles, it is necessary to increase the number of movable touch pieces. When the number of movable touch pieces increases, structure for supporting the movable touch pieces will be enlarged. Therefore, the relay will be enlarged and it becomes difficult to do layout in a device in which the relay is mounted.

In addition, it can be considered to increase the number of poles by combining a plurality of relays to constitute a relay module. For example, for 4-pole relays, as illustrated in FIG. 17, arranging and combining eight relays 200 on a substrate 300 can constitute a 32-pole relay module 100 as a whole. However, even in this case, there is a problem that the entire relay module will be enlarged. In addition, there is also a problem that manufacturing man-hours will increase because it is necessary to solder the plurality of relays on the substrate.

One or more embodiments may provide a relay that is easy to do layout and can increase the number of contact poles while inhibiting the enlargement.

Means for Solving the Problem

A relay according to one or more embodiments includes a first base substrate, a plurality of first substrate side contact points, a plurality of first movable touch pieces, a movable member, and a coil block. The plurality of first substrate side contact points is arranged on the first base substrate. The plurality of first movable touch pieces includes first contacts arranged to face the first substrate side contact points. The movable member is configured to switch, by rotation, between a first state and a second state. In the first state, the movable member presses the plurality of first movable touch pieces to bring the first contacts into contact with the first substrate side contact points. When the movable member is in the second state, the first contacts are separated from the first substrate side contact points. The coil block includes a coil and causes the movable member to rotate by electromagnetic force generated by energization of the coil. A rotation axis of the movable member is parallel to an axis of the coil. The plurality of first substrate side contact points is arranged side by side in an axial direction of the coil on the first base substrate. The plurality of first movable touch pieces is arranged side by side in the axial direction of the coil.

In the relay according to one or more embodiments, the plurality of first substrate side contact points and the plurality of first movable touch pieces can be arranged side by side within a range of length in the axial direction of the coil. Therefore, as the length in the axial direction of the coil increases, more first substrate side contact points and first movable touch pieces can be arranged. In addition, since the plurality of first substrate side contact points are arranged on the first base substrate, the plurality of first substrate side contact points can be densely arranged in a small area. This allows arrangement of a lot of first substrate side contact points and first movable touch pieces while inhibiting enlargement of the relay.

Furthermore, even if the number of first substrate side contact points and first movable touch pieces increases, the increase in size in another direction can be inhibited, although the length in the axial direction of the coil increases. For this reason, the relay can be placed in a narrow gap in a device in which the relay is to be mounted. This facilitates relay layout.

The coil and the movable member may each have a longitudinal direction in the axial direction of the coil. In this case, the number of first substrate side contact points and first movable touch pieces can be increased.

A longitudinal direction of the first base substrate may be parallel to the axial direction of the coil. In this case, the number of first substrate side contact points and first movable touch pieces can be increased.

The first base substrate, the movable member, and the coil block may be disposed in a stacked manner in a direction perpendicular to a surface of the first base substrate. In this case, the first base substrate, the movable member, and the coil block can be disposed compactly.

The relay may further include a second base substrate, a plurality of second substrate side contact points, and a plurality of second movable touch pieces. The second base substrate may be spaced apart from the first base substrate in the direction perpendicular to the surface of the first base substrate. The plurality of second substrate side contact points may be arranged side by side in the axial direction of the coil on a surface of the second base substrate facing the first base substrate. The plurality of second movable touch pieces may include second contacts arranged to face the second substrate side contact points. The plurality of second movable touch pieces may be arranged side by side in the axial direction of the coil. The movable member may be disposed between the first movable touch pieces and the second movable touch pieces. The movable member may include a first pressing portion and a second pressing portion. The first pressing portion may be disposed to face the plurality of first movable touch pieces. The second pressing portion may be disposed to face the plurality of second movable touch pieces.

In this case, the number of contact points can further be increased. In addition, rotation of the common movable member makes it possible to switch contact/non-contact between the first contacts and the first substrate side contact points, and contact/non-contact between the second contacts and the second substrate side contact points. This can inhibit enlargement of the relay while increasing the number of contact points.

The first pressing portion and the second pressing portion may be symmetrically disposed with respect to the rotation axis of the movable member. In this case, rotation of the movable member allows the first pressing portion to press the first movable touch pieces and allows the second pressing portion to press the second movable touch pieces simultaneously.

The first base substrate may include a plurality of first terminal portions, a plurality of second terminal portions, and a plurality of third terminal portions. The plurality of first terminal portions may be electrically connected to the plurality of first substrate side contact points. The plurality of second terminal portions may be electrically connected to the plurality of first movable touch pieces. The relay may further include a first pattern frame. The first pattern frame is disposed between the first base substrate and the second base substrate. The first pattern frame couples the first base substrate and the second base substrate. The first pattern frame includes a plurality of first patterns that electrically connects the plurality of third terminal portions and the plurality of second substrate side contact points.

In this case, together with the first terminal portions and the second terminal portions, the third terminal portions electrically connected to the second substrate side contact points of the second base substrate can be arranged on the first base substrate.

The first base substrate may include a plurality of fourth terminal portions. The relay may further include a second pattern frame. The second pattern frame is disposed between the first base substrate and the second base substrate. The second pattern frame couples the first base substrate and the second base substrate. The second pattern frame includes a plurality of second patterns that electrically connects the plurality of fourth terminal portions and the plurality of second movable touch pieces.

In this case, the fourth terminal portions electrically connected to the second movable touch pieces can be arranged on the first base substrate, together with the first terminal portions and the second terminal portions.

The first pattern frame and the second pattern frame may be spaced apart from each other. The movable member may be disposed between the first pattern frame and the second pattern frame. In this case, the movable member, the first base substrate, the second base substrate, the first pattern frame, and the second pattern frame can be disposed compactly.

The relay may further include a plurality of third substrate side contact points, a plurality of fourth substrate side contact points, a plurality of third movable touch pieces, and a plurality of fourth movable touch pieces. The plurality of third substrate side contact points may be arranged side by side in the axial direction of the coil on the first base substrate. The plurality of fourth substrate side contact points may be arranged side by side in the axial direction of the coil on the second base substrate. The plurality of third movable touch pieces may include third contacts arranged to face the third substrate side contact points. The plurality of third movable touch pieces may be arranged side by side in the axial direction of the coil. The plurality of fourth movable touch pieces may include fourth contacts arranged to face the fourth substrate side contact points. The plurality of fourth movable touch pieces may be arranged side by side in the axial direction of the coil. The movable member may include a third pressing portion and a fourth pressing portion. The third pressing portion may be disposed to face the plurality of third movable touch pieces. The fourth pressing portion may be disposed to face the plurality of fourth movable touch pieces.

For example, when the movable member is in the first state, the first pressing portion may press the plurality of first movable touch pieces to bring the plurality of first contacts into contact with the first substrate side contact points. Also, when the movable member is in the first state, the second pressing portion may press the plurality of second movable touch pieces to bring the plurality of second contacts into contact with the second substrate side contact points. Also, when the movable member is in the first state, the plurality of third contacts may be separated from the third substrate side contact points, and the plurality of fourth contacts may be separated from the fourth substrate side contact points. When the movable member is in the second state, the third pressing portion may press the plurality of third movable touch pieces to bring the plurality of third contacts into contact with the third substrate side contact points. Also, when the movable member is in the second state, the fourth pressing portion may press the plurality of fourth movable touch pieces to bring the plurality of fourth contacts into contact with the fourth substrate side contact points. Also, when the movable member is in the second state, the plurality of first contacts may be separated from the first substrate side contact points, and the plurality of second contacts may be separated from the second substrate side contact points.

In this case, the number of contact points can further be increased. In addition, rotation of the common movable member makes it possible to switch contact/non-contact between the first contacts and the first substrate side contact points, and contact/non-contact between the second contacts and the second substrate side contact points. Also, rotation of the common movable member makes it possible to switch contact/non-contact between the third contacts and the third substrate side contact points, and contact/non-contact between the fourth contacts and the fourth substrate side contact points. This can inhibit enlargement of the relay while increasing the number of contact points.

The plurality of third substrate side contact points may be arranged on an opposite side of the plurality of first substrate side contact points with respect to the rotation axis on the first base substrate. The plurality of fourth substrate side contact points may be arranged on an opposite side of the plurality of second substrate side contact points with respect to the rotation axis on the second base substrate. In this case, rotation of the common movable member makes it possible to switch contact/non-contact between the first contacts and the first substrate side contact points, and contact/non-contact between the second contacts and the second substrate side contact points. Also, rotation of the common movable member makes it possible to switch contact/non-contact between the third contacts and the third substrate side contact points, and contact/non-contact between the fourth contacts and the fourth substrate side contact points.

The first movable touch pieces and the third movable touch pieces may be electrically connected. The second movable touch pieces and the fourth movable touch pieces may be electrically connected. In this case, continuity corresponding to a-contact, b-contact, and c-contact can be formed.

The movable member may include a first recess and a second recess. The first recess may extend along the axial direction of the coil. The second recess may be provided on an opposite side of the first recess with respect to the rotation axis. The second recess may extend along the axial direction of the coil. The coil block may further include an iron core, a first yoke, and a second yoke. The iron core may be disposed within the coil and extend in the axial direction of the coil. The first yoke may be disposed within the first recess and extend in the axial direction of the coil. The second yoke may be disposed within the second recess and extend in the axial direction of the coil. The first yoke may be connected to one end of the iron core in the axial direction of the coil. The second yoke may be connected to another end of the iron core in the axial direction of the coil. In this case, a connection section between the first yoke and the iron core, and a connection section between the second yoke and the iron core can be downsized.

EFFECT OF THE INVENTION

One or more embodiments can provide a relay that is easy to do layout and allows increase in the number of contact poles while inhibiting enlargement.

MODE FOR CARRYING OUT THE INVENTION

Figure 1:
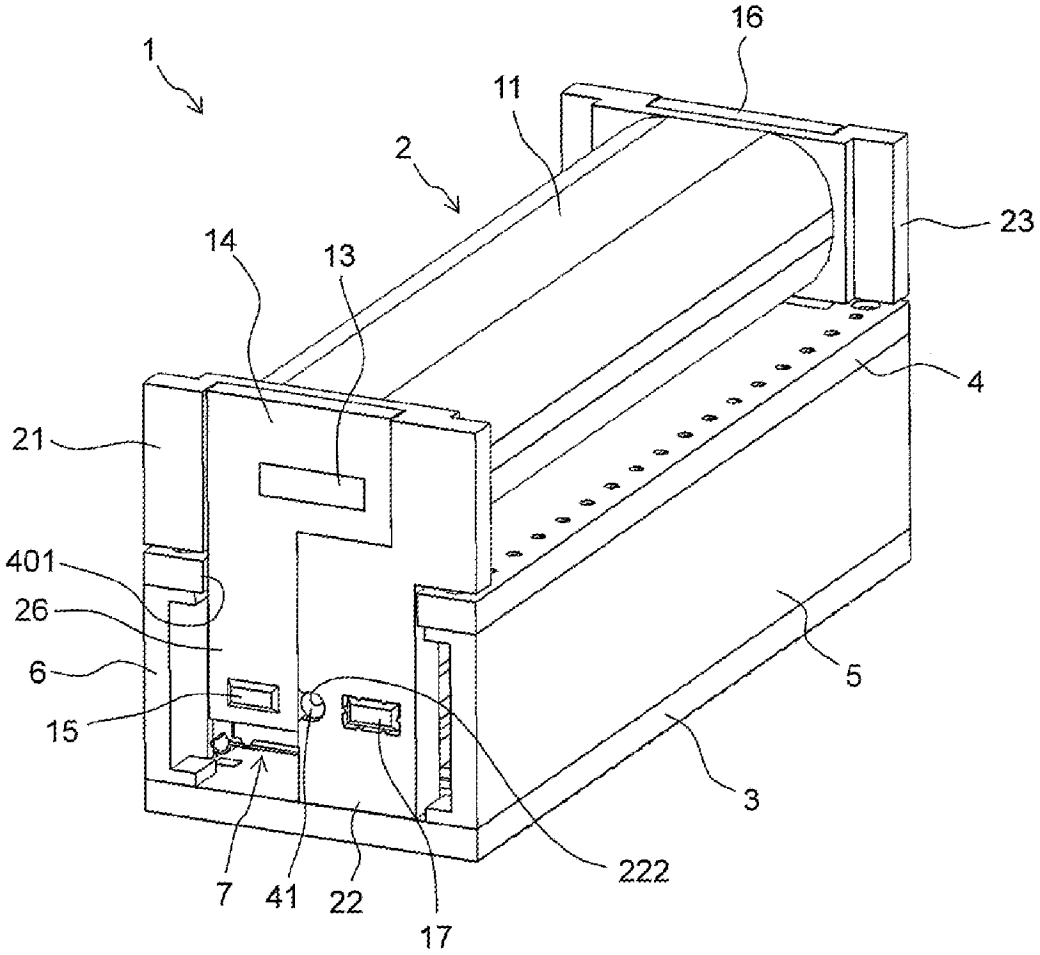
FIG. 1 is a perspective view of a relay according to a first embodiment.
Figure 2:
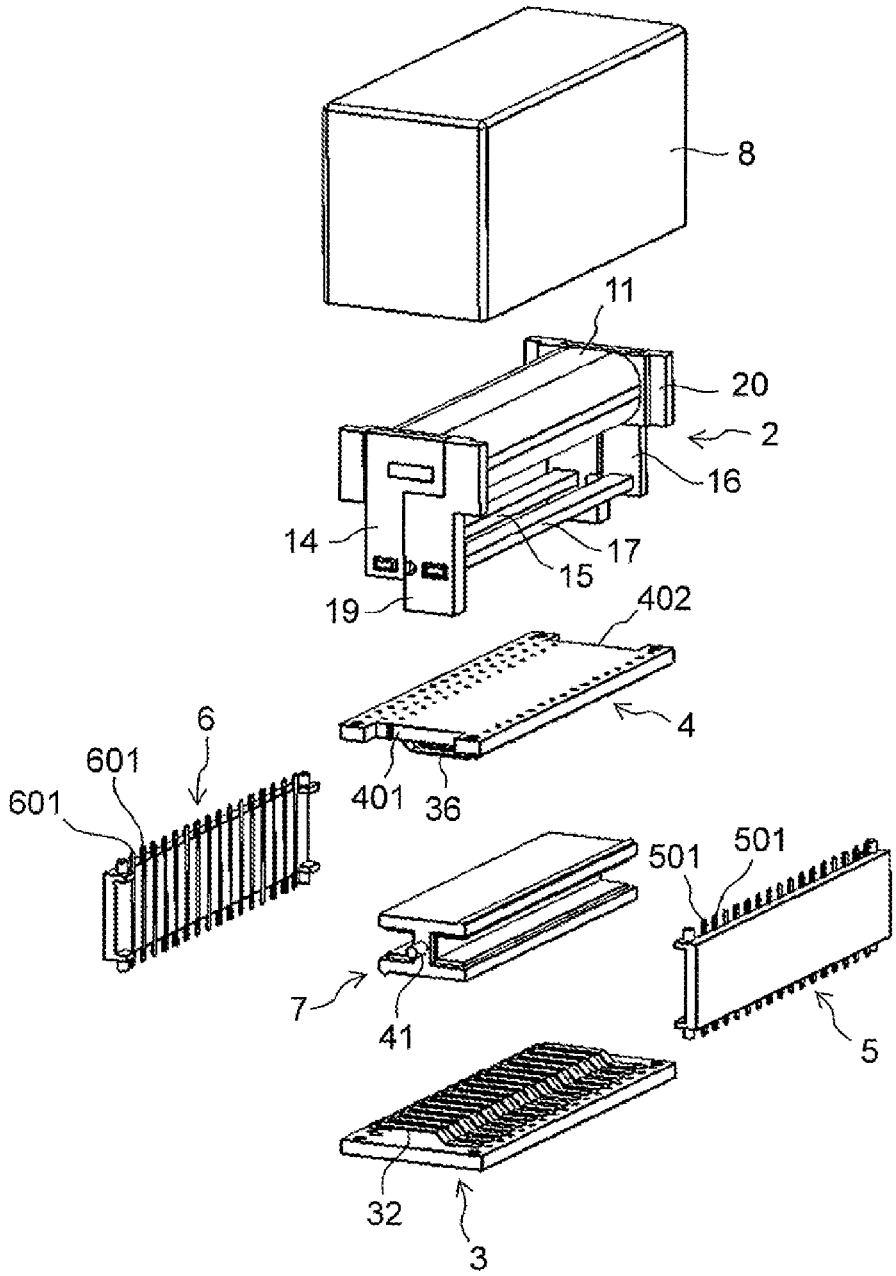
FIG. 2 is an exploded perspective view of a relay.

A relay according to one or more embodiments will be described with reference to the drawings. FIG. 1 is a perspective view of a relay 1 according to a first embodiment. FIG. 2 is an exploded perspective view of the relay 1. As illustrated in FIG. 1 and FIG. 2, the relay 1 has a rectangular shape as a whole. The relay 1 includes a coil block 2, a first base substrate 3, a second base substrate 4, a first pattern frame 5, a second pattern frame 6, a movable member 7, and a cover 8. Note that the cover 8 is omitted in FIG. 1.

As illustrated in FIG. 1, the first base substrate 3, the movable member 7, the second base substrate 4, and the coil block 2 are disposed in a stacked manner in a direction perpendicular to a surface of the first base substrate 3. Note that in one or more embodiments, the direction perpendicular to the surface of the first base substrate 3 is referred to as a vertical direction. Also, in one or more embodiments, a direction in which the movable member 7 is disposed with respect to the first base substrate 3 is referred to as upward, and an opposite direction thereto is referred to as downward. In addition, a direction perpendicular to the vertical direction is referred to as lateral. However, these directions are used only for convenience of description, and do not limit a mounting direction of the relay 1 or the like.

Figure 3:
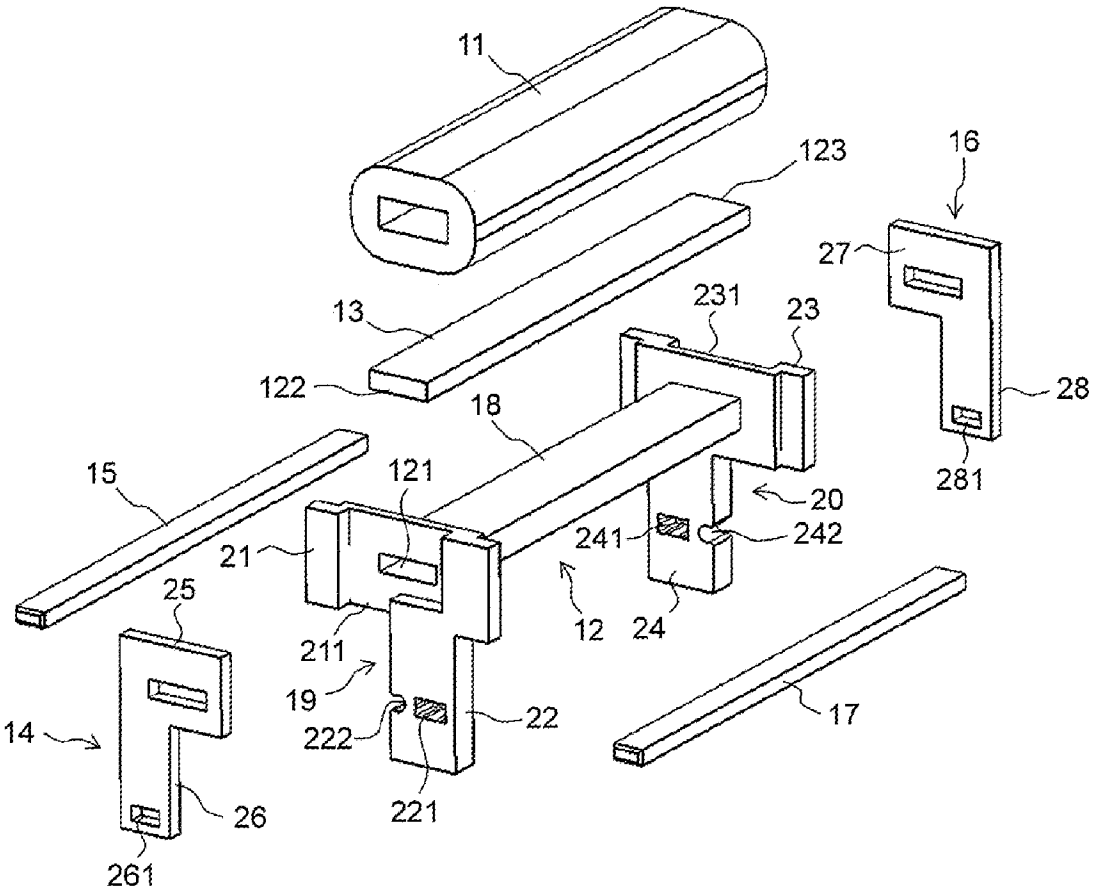
FIG. 3 is an exploded perspective view of a coil block.

FIG. 3 is an exploded perspective view of the coil block 2. As illustrated in FIG. 3, the coil block 2 includes a coil 11. The coil 11 has a long shape in a direction of an axis of the coil 11, which is hereinafter referred to as "coil axis." The coil 11 is disposed above the second base substrate 4. The coil block 2 causes the movable member 7 to rotate by electromagnetic force generated by energization of the coil 11. The coil block 2 includes a spool 12, an iron core 13, a first coupling yoke 14, a first yoke 15, a second coupling yoke 16, and a second yoke 17.

The spool 12 includes a coupling portion 18, a first flange member 19, and a second flange member 20. The coupling portion 18 couples the first flange member 19 and the second flange member 20. The coil 11 is wound around the coupling portion 18. The first flange member 19 and the second flange member 20 have shapes identical to each other. The first flange member 19 and the second flange member 20 are disposed in a direction opposite to each other in a coil axis direction.

The first flange member 19 includes a first flange portion 21 and a first strut 22. The first strut 22 projects downward from the first flange portion 21. The second flange member 20 includes a second flange portion 23 and a second strut 24. The second strut 24 projects downward from the second flange portion 23. The first flange portion 21 is connected to one end of the coupling portion 18. The second flange portion 23 is connected to another end of the coupling portion 18. As illustrated in FIG. 1, the first strut 22 is disposed on the first base substrate 3. The second strut 24 is also disposed on the first base substrate 3 in a similar manner to the first strut 22.

The iron core 13 is disposed within the coil 11 and extends in the coil axis direction. In particular, a hole 121 passing through the coupling portion 18, the first flange portion 21, and the second flange portion 23 is formed in the spool 12. The iron core 13 is passed through the hole 121 of the spool 12. The iron core 13 has a first end 122 and a second end 123 in the coil axis direction.

The first coupling yoke 14 couples the iron core 13 and the first yoke 15. The first coupling yoke 14 includes a first attachment portion 25 and a first yoke support portion 26. The first attachment portion 25 is connected to the first end 122 of the iron core 13. A first attachment recess 211 is formed in the first flange portion 21, and the first attachment portion 25 is disposed in the first attachment recess 211. The first yoke support portion 26 projects downward from the first attachment portion 25.

The second coupling yoke 16 couples the iron core 13 and the second yoke 17. The second coupling yoke 16 includes a second attachment portion 27 and a second yoke support portion 28. The second attachment portion 27 is connected to the second end 123 of the iron core 13. A second attachment recess 231 is formed in the second flange portion 23, and the second attachment portion 27 is disposed in the second attachment recess 231. The second yoke support portion 28 projects downward from the second attachment portion 27.

The first yoke 15 has a bar shape extending in the coil axis direction. The first yoke 15 is connected to the first end 122 of the iron core 13 via the first coupling yoke 14. In particular, a hole 261 is provided in the first yoke support portion 26 of the first coupling yoke 14. A hole 241 is provided in the second strut 24 of the second flange member 20. One end of the first yoke 15 is passed through the hole 261 of the first yoke support portion 26. Another end of the first yoke 15 is passed through the hole 241 of the second strut 24.

The second yoke 17 has a bar shape extending in the coil axis direction. The second yoke 17 is connected to the second end 123 of the iron core 13 via the second coupling yoke 16. In particular, a hole 281 is provided in the second yoke support portion 28 of the second coupling yoke 16. A hole 221 is provided in the first strut 22 of the first flange member 19. One end of the second yoke 17 is passed through the hole 281 of the second yoke support portion 28. Another end of the second yoke 17 is passed through the hole 221 of the first strut 22.

Note that the iron core 13, the first coupling yoke 14, the first yoke 15, the second coupling yoke 16, and the second yoke 17 are formed of, for example, a semi-hard magnetic material. However, these components may be formed of a material different from the semi-hard magnetic material.

Figure 4:
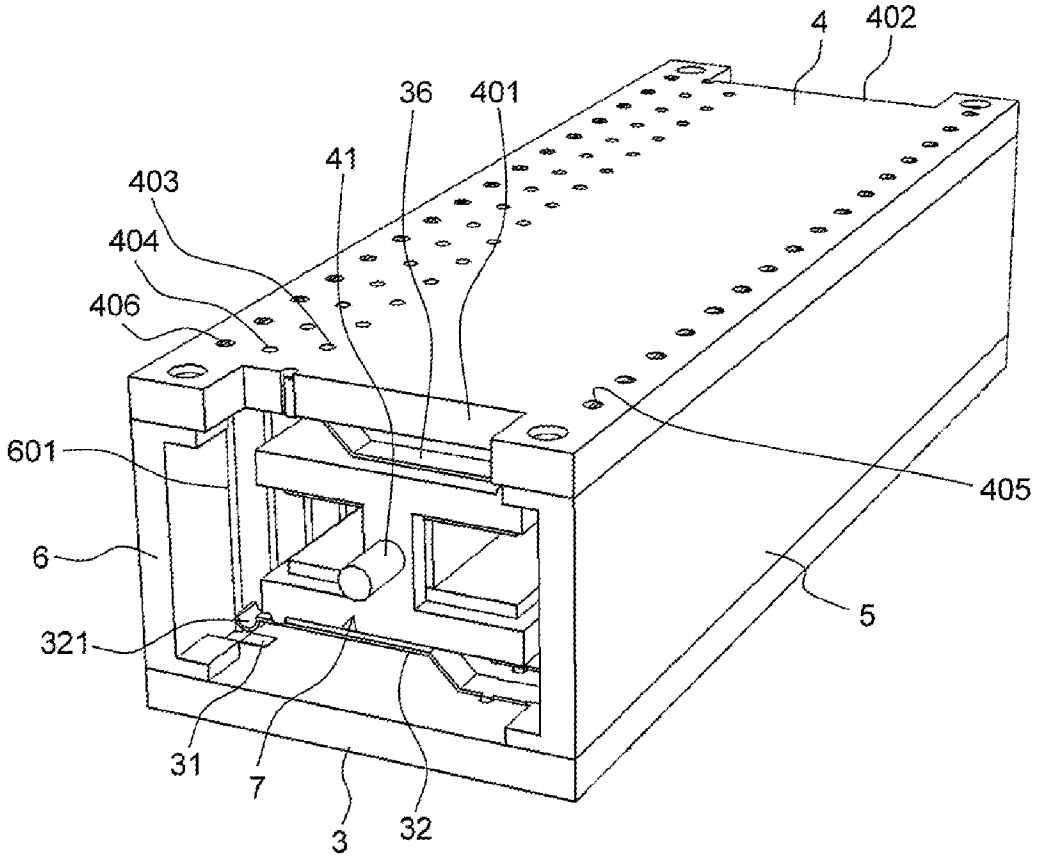
FIG. 4 is a diagram illustrating a state where a coil block is omitted, such as in FIG. 1.

FIG. 4 illustrates a state in which the coil block 2 is omitted in FIG. 1. As illustrated in FIG. 4, the first base substrate 3, the second base substrate 4, the first pattern frame 5, and the second pattern frame 6 are combined in a rectangular box shape. The first base substrate 3 forms a bottom of the box shape. The second base substrate 4 forms a bottom of the box shape. The first pattern frame 5 forms one side surface of the box shape. The second pattern frame 6 forms another side surface of the box shape.

The first base substrate 3 and the second base substrate 4 each have a rectangular shape. The first base substrate 3 and the second base substrate 4 are disposed in parallel to each other. A longitudinal direction of the first base substrate 3 and the second base substrate 4 is parallel to the coil axis. The second base substrate 4 is disposed above the first base substrate 3. The second base substrate 4 is spaced apart from the first base substrate 3 in the direction perpendicular to the surface of the first base substrate 3.

The first pattern frame 5 and the second pattern frame 6 each have a rectangular shape. The first pattern frame 5 and the second pattern frame 6 are disposed between the first base substrate 3 and the second base substrate 4, and couple the first base substrate 3 and the second base substrate 4. A lower end of the first pattern frame 5 and a lower end of the second pattern frame 6 are fixed to the first base substrate 3. An upper end of the first pattern frame 5 and an upper end of the second pattern frame 6 are fixed to the second base substrate 4. The first pattern frame 5 and the second pattern frame 6 are spaced from each other.

A length in a transverse direction of the first base substrate 3 is larger than spacing between the first base substrate 3 and the second base substrate 4. That is, the length in the transverse direction of the first base substrate 3 is larger than a height of the first pattern frame 5. A length in a transverse direction of the second base substrate 4 is larger than the spacing between the first base substrate 3 and the second base substrate 4. That is, the length in the transverse direction of the second base substrate 4 is larger than the height of the first pattern frame 5.

The movable member 7 is disposed between the first base substrate 3 and the second base substrate 4. The movable member 7 is disposed between the first pattern frame 5 and the second pattern frame 6. That is, the movable member 7 is disposed within a space surrounded by the first base substrate 3, the second base substrate 4, the first pattern frame 5, and the second pattern frame 6.

Figure 5:
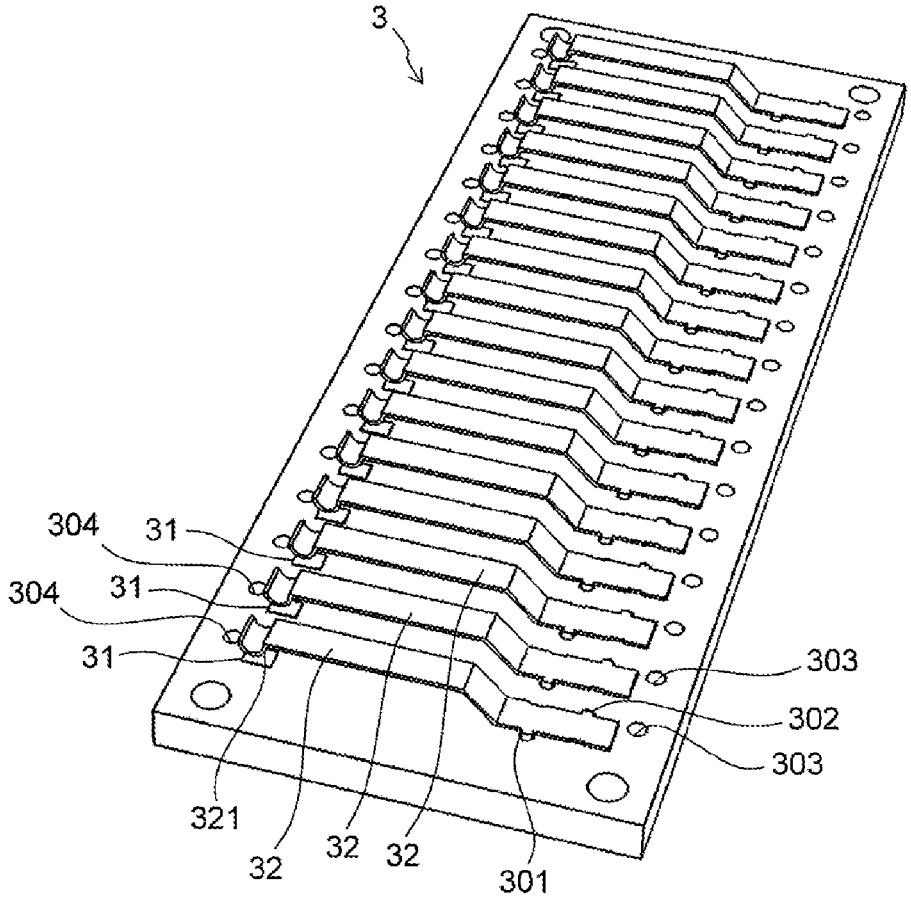
FIG. 5 is a perspective view of a first base substrate.

FIG. 5 is a perspective view of the first base substrate 3. As illustrated in FIG. 5, a plurality of first substrate side contact points 31 is arranged on a top surface of the first base substrate 3. Note that in the drawing, symbols 31 are assigned to only part of the plurality of first substrate side contact points 31, and symbols of other first substrate side contact points 31 are omitted. Similarly, symbols are assigned only to part of a plurality of other members, and other symbols are omitted.

The first substrate side contact points 31 are formed of a conductive material. The plurality of first substrate side contact points 31 is arranged side by side in a longitudinal direction of the first base substrate 3. The plurality of first substrate side contact points 31 forms a straight line along the longitudinal direction of the first base substrate 3. As described above, the longitudinal direction of the first base substrate 3 is parallel to the coil axis direction. Therefore, the plurality of first substrate side contact points 31 is arranged side by side in the coil axis direction on the first base substrate 3.

A plurality of first movable touch pieces 32 is attached to the first base substrate 3. The first movable touch pieces 32 are formed of a conductive material. The first movable touch pieces 32 are formed of an elastic material. The plurality of first movable touch pieces 32 is arranged side by side in the longitudinal direction of the first base substrate 3. The plurality of first movable touch pieces 32 forms a straight line along the longitudinal direction of the first base substrate 3. Each of the first movable touch pieces 32 is arranged so as to extend in the transverse direction of the first base substrate 3.

Figure 6:
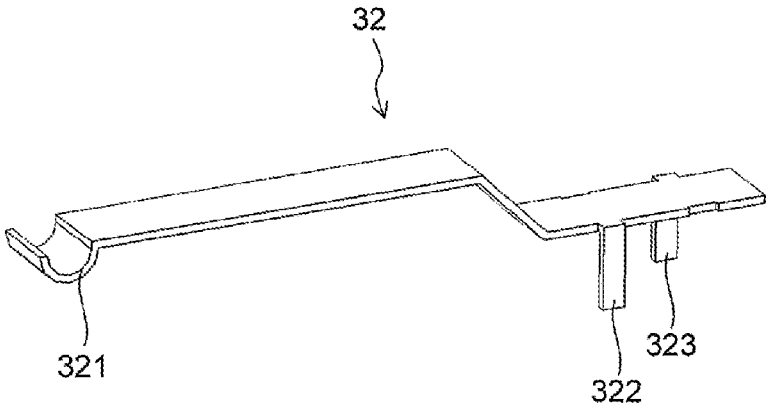
FIG. 6 is a perspective view of a first movable touch piece.

FIG. 6 is a perspective view of the first movable touch piece 32. As illustrated in FIG. 6, the first movable touch piece 32 has a shape in which a long and narrow plate is flexed. The first movable touch piece 32 includes a first contact 321. The first contact 321 is provided at a leading end portion of the first movable touch piece 32. The first contact 321 has a shape curved in an arc. The first contact 321 is disposed to face the first substrate side contact point 31.

The first movable touch piece 32 includes attachment portions 322 and 323. The attachment portions 322 and 323 are provided at a proximal portion of the first movable touch piece 32. The attachment portions 322 and 323 are attached to the first base substrate 3. The attachment portions 322 and 323 are inserted into first attachment holes 301 and 302, respectively, provided in the first base substrate 3 (refer to FIG. 5). Accordingly, the first movable touch piece 32 is supported by the first base substrate 3 in a cantilever fashion.

Figure 7:
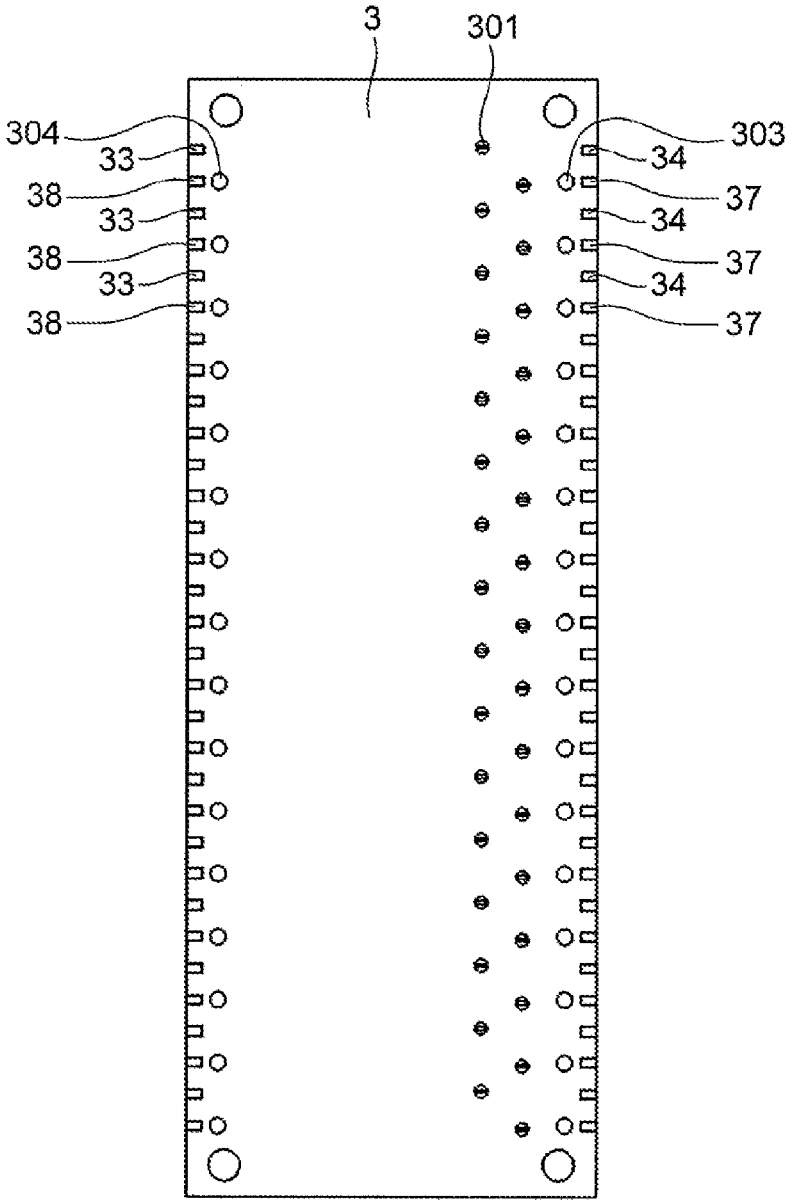
FIG. 7 is a bottom view of a first base substrate.

FIG. 7 is a bottom view of the first base substrate 3. Note that in one or more embodiments, a surface on which the first substrate side contact points 31 are provided in the first base substrate 3 is referred to as a top surface, whereas an opposite surface thereto is referred to as a bottom surface. As illustrated in FIG. 7, a plurality of first terminal portions 33 and a plurality of second terminal portions 34 are provided on the bottom surface of the first base substrate 3. The first terminal portions 33 and the second terminal portions 34 are formed of a conductive material.

The plurality of first terminal portions 33 is arranged side by side on one side portion of the bottom surface of the first base substrate 3 in the longitudinal direction of the first base substrate 3. The plurality of second terminal portions 34 is arranged side by side on another side portion of the bottom surface of the first base substrate 3 in the longitudinal direction of the first base substrate 3.

The first base substrate 3 is a so-called printed board. The plurality of first substrate side contact points 31, the plurality of first terminal portions 33, and the plurality of second terminal portions 34 are patterns formed on the printed board, and are formed of an electric conductor, such as copper foil. The plurality of first substrate side contact points 31, the plurality of first terminal portions 33, and the plurality of second terminal portions 34 are not covered with an insulator, but are exposed.

The plurality of first terminal portions 33 are electrically connected to the plurality of first substrate side contact points 31 by pattern wiring formed on the printed board. In addition, the above-described first attachment holes 301 of the first base substrate 3 to which the first movable touch pieces 32 are attached are through holes, and are electrically connected to the plurality of second terminal portions 34 by pattern wiring formed on the printed board. Accordingly, the plurality of first movable touch pieces 32 are electrically connected to the plurality of second terminal portions 34.

Figure 8:
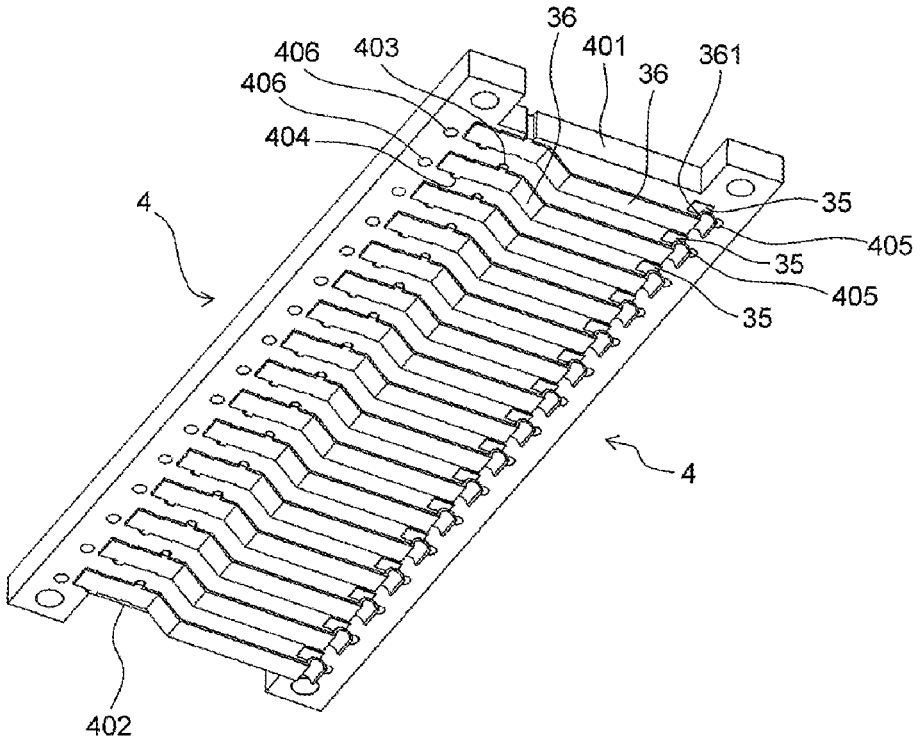
FIG. 8 is a perspective view of a second base substrate.

FIG. 8 is a perspective view of the second base substrate 4. As illustrated in FIG. 8, a plurality of second substrate side contact points 35 is arranged on a bottom surface of the second base substrate 4. The bottom surface of the second base substrate 4 is a surface facing the first base substrate 3.

The second substrate side contact points 35 are formed of a conductive material. The plurality of second substrate side contact points 35 is arranged side by side in a longitudinal direction of the second base substrate 4. The plurality of second substrate side contact points 35 forms a straight line along the longitudinal direction of the second base substrate 4. As described above, the longitudinal direction of the second base substrate 4 is parallel to the coil axis direction. Therefore, the plurality of second substrate side contact points 35 is arranged side by side in the coil axis direction on the second base substrate 4.

A plurality of second movable touch pieces 36 is attached to the second base substrate 4. The plurality of second movable touch pieces 36 is arranged side by side in the longitudinal direction of the second base substrate 4. The plurality of second movable touch pieces 36 forms a straight line along the longitudinal direction of the second base substrate 4. Each of the second movable touch pieces 36 is arranged so as to extend in the transverse direction of the second base substrate 4.

The second movable touch piece 36 includes a second contact 361. The second contact 361 is disposed to face the second substrate side contact point 35. Structure of the second movable touch piece 36 is identical to structure of the above-described first movable touch piece 32, and thus detailed description is omitted.

Recesses 401 and 402 are provided in end portions in the longitudinal direction of the second base substrate 4. As illustrated in FIG. 1, the first strut 22 of the first flange member 19 and the first yoke support portion 26 of the first coupling yoke 14 of the coil block 2 are disposed in the recess 401. In addition, the second strut 24 of the second flange member 20 and the second yoke support portion 28 of the second coupling yoke 16 of the coil block 2 are disposed in the recess 402.

Figure 9:
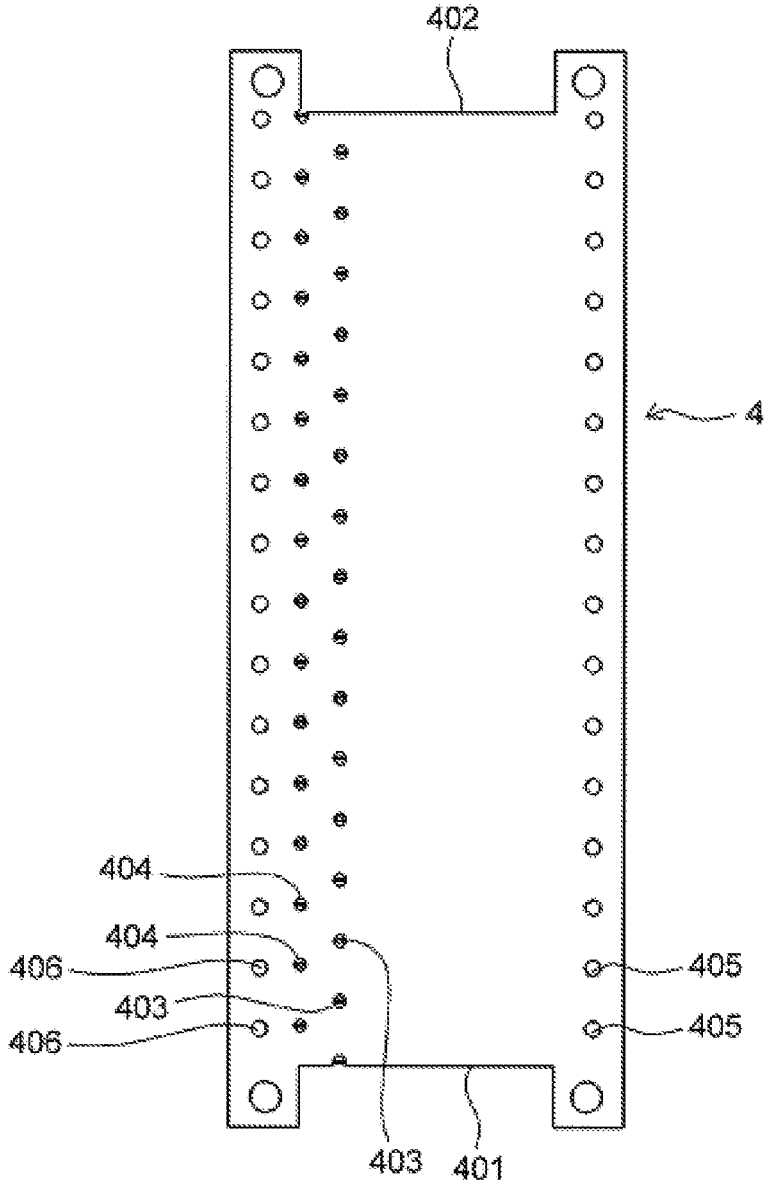
FIG. 9 is a top view of a second base substrate.

FIG. 9 is a top view of the second base substrate 4. As illustrated in FIG. 8 and FIG. 9, a plurality of second attachment holes 403 and 404 is provided in the second base substrate 4. The second movable touch pieces 36 are attached to the second attachment holes 403 and 404. A plurality of first coupling holes 405 and a plurality of second coupling holes 406 are provided in the second base substrate 4. The plurality of first coupling holes 405 is arranged side by side on one side portion of the second base substrate 4 in the longitudinal direction of the second base substrate 4. The plurality of second coupling holes 406 is arranged side by side on another side portion of the second base substrate 4 in the longitudinal direction of the second base substrate 4.

The second base substrate 4 is a so-called printed board. The plurality of second substrate side contact points 35 is patterns formed on the printed board, and is formed of an electric conductor, such as copper foil. The plurality of second substrate side contact points 35 is not covered with an insulator, but is exposed.

The second attachment holes 404 to which the above-described second movable touch pieces 36 are attached, the first coupling holes 405, and the second coupling holes 406 are through holes. The plurality of second substrate side contact points 35 is electrically connected to the plurality of first coupling holes 405 by pattern wiring formed on the printed board. The plurality of second attachment holes 404 is electrically connected to the plurality of second coupling holes 406 by pattern wiring formed on the printed board.

As illustrated in FIG. 7, the first base substrate 3 includes a plurality of third terminal portions 37 and a plurality of fourth terminal portions 38. The plurality of third terminal portions 37 and the plurality of fourth terminal portions 38 are patterns formed on the printed board, and are formed of an electric conductor, such as copper foil. The plurality of third terminal portions 37 and the plurality of fourth terminal portions 38 are not covered with an insulator, but are exposed.

The first base substrate 3 includes a plurality of third coupling holes 303 and a plurality of fourth coupling holes 304. The plurality of third coupling holes 303 and the plurality of fourth coupling holes 304 are through holes. The plurality of third coupling holes 303 is electrically connected to the plurality of third terminal portions 37 by pattern wiring formed on the printed board. The plurality of fourth coupling holes 304 is electrically connected to the plurality of fourth terminal portions 38 by pattern wiring formed on the printed board.

As illustrated in FIG. 2, the first pattern frame 5 includes a plurality of first patterns 501. The plurality of first patterns 501 each extends in a vertical direction. The second pattern frame 6 includes a plurality of second patterns 601. The plurality of second patterns 601 each extends in a vertical direction.

One end of the first pattern 501 is attached to the first coupling hole 405 of the second base substrate 4. Another end of the first pattern 501 is attached to the third coupling hole 303 of the first base substrate 3. Accordingly, the second substrate side contact point 35 is electrically connected to the third terminal portion 37 of the first base substrate 3 via the first pattern 501.

One end of the second pattern 601 is attached to the second coupling hole 406 of the second base substrate 4. Another end of the second pattern 601 is attached to the fourth coupling hole 304 of the first base substrate 3. Accordingly, the second movable touch piece 36 is electrically connected to the fourth terminal portion 38 of the first base substrate 3 via the second pattern 601.

Note that a plurality of terminals projecting from the first base substrate 3 may be attached to each of the terminal portions 33, 34, 37, and 38. Alternatively, each terminal portion may be provided with a ball grid array (BGA), or a land grid array (LGA).

The movable member 7 illustrated in FIG. 2 and FIG. 4 is rotatably provided with respect to the first base substrate 3 and the second base substrate 4. The movable member 7 includes a rotation shaft 41. As illustrated in FIG. 1 and FIG. 3, the coil block 2 includes shaft support portions 222 and 242. The shaft support portions 222 and 242 rotatably support the rotation shaft 41 of the movable member 7. In particular, as illustrated in FIG. 3, the shaft support portions 222 and 242 include the first shaft support portion 222 provided in the first strut 22 of the first flange member 19 and the second shaft support portion 242 provided in the second strut 24 of the second flange member 20. The first shaft support portion 222 and the second shaft support portion 242 each have a shape recessed in an arc.

The movable member 7 is provided rotatably around the rotation axis that passes through the rotation shaft 41. The rotation axis is parallel to the coil axis. That is, the rotation axis is parallel to the longitudinal direction of the first base substrate 3 and to the longitudinal direction of the second base substrate 4. The movable member 7 has a long shape in the coil axis direction.

Figure 10:
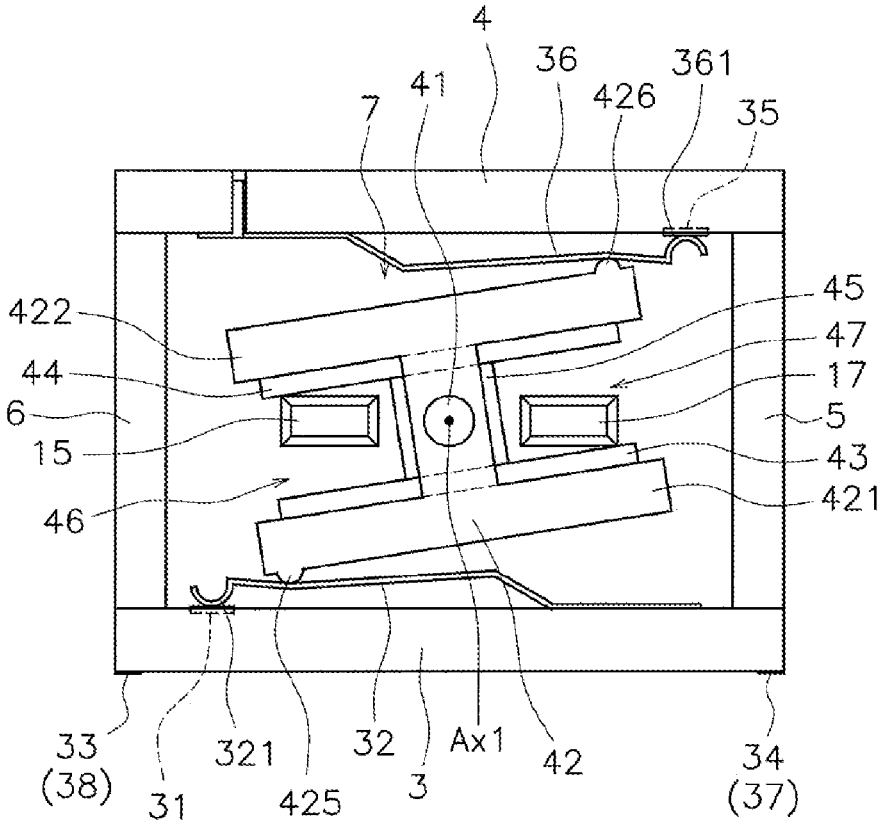
FIG. 10 is a view illustrating a movable member and surrounding structure thereof viewed from a rotation axis direction of the movable member.
Figure 11:
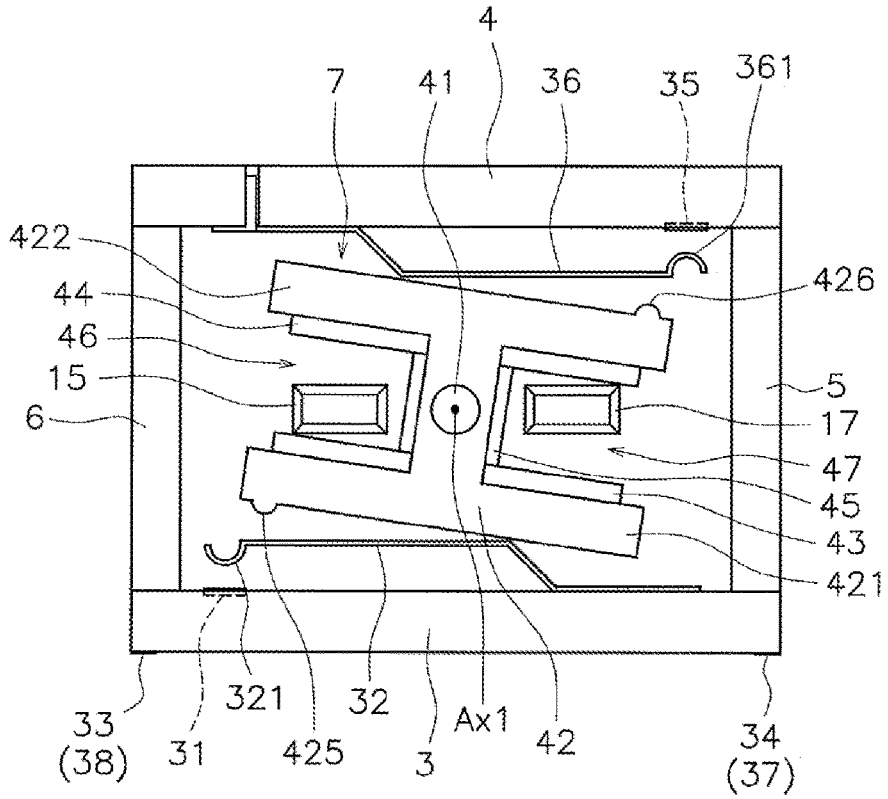
FIG. 11 is a view illustrating a movable member and surrounding structure thereof viewed from a rotation axis direction of the movable member.

FIG. 10 and FIG. 11 are views illustrating the movable member 7 and surrounding structure thereof viewed from the rotation axis direction of the movable member 7. The movable member 7 is disposed between the first movable touch pieces 32 and the second movable touch pieces 36. The movable member 7 is configured to switch between a first state illustrated in FIG. 10 and a second state illustrated in FIG. 11, by rotating with respect to the first base substrate 3 and the second base substrate 4.

In the first state illustrated in FIG. 10, the movable member 7 presses the plurality of first movable touch pieces 32 so as to bring the first contacts 321 into contact with the first substrate side contact points 31. Also, in the first state, the movable member 7 presses the plurality of second movable touch pieces 36 so as to bring the second contacts 361 into contact with the second substrate side contact points 35.

In the second state illustrated in FIG. 11, the movable member 7 presses neither the first movable touch pieces 32 nor the second movable touch pieces 36. In the second state, the first contacts 321 are separated from the first substrate side contact points 31, and the second contacts 361 are separated from the second substrate side contact points 35.

Figure 12:
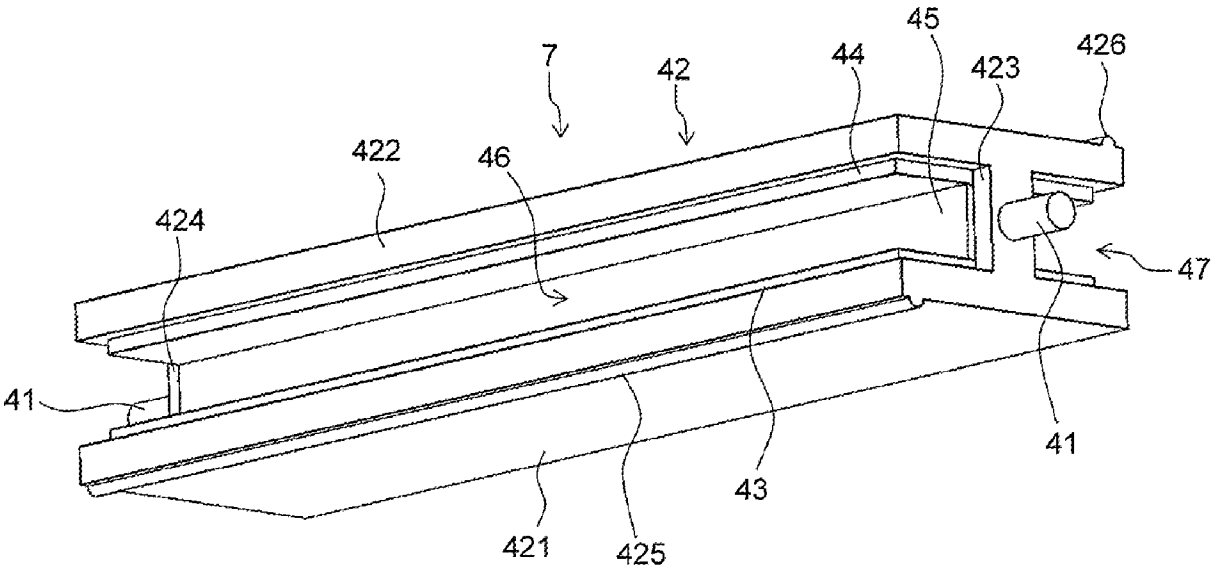
FIG. 12 is a perspective view of a movable member.

FIG. 12 is a perspective view of the movable member 7. As illustrated in FIG. 10 to FIG. 12, the movable member 7 includes a support member 42, a first armature 43, a second armature 44, and a permanent magnet 45. The support member 42 supports the first armature 43, the second armature 44, and the permanent magnet 45. The above-described rotation shaft 41 projects from the support member 42. The support member 42 is formed of an insulating material such as resin.

The support member 42 includes a first plate 421, a second plate 422, and coupling portions 423 and 424. The first plate 421 and the second plate 422 are symmetrically disposed with respect to a rotation axis A×1 of the movable member 7. The first plate 421 and the second plate 422 each have a substantially rectangular shape that is long in the coil axis direction. The coupling portions 423 and 424 are disposed between the first plate 421 and the second plate 422, and couple the first plate 421 and the second plate 422. The above-described rotation shaft 41 projects from the coupling portions 423 and 424. In particular, the coupling portions 423 and 424 include the first coupling portion 423 and the second coupling portion 424. The first coupling portion 423 and the second coupling portion 424 couple ends of the first plate 421 and the second plate 422 in the longitudinal direction.

The support member 42 includes a first pressing portion 425 and a second pressing portion 426. The first pressing portion 425 is provided so as to project from the first plate 421. The first pressing portion 425 is disposed to face the plurality of first movable touch pieces 32. The first pressing portion 425 extends in the coil axis direction. The second pressing portion 426 is provided so as to project from the second plate 422. The second pressing portion 426 is disposed to face the plurality of second movable touch pieces 36.

The second pressing portion 426 extends in the coil axis direction. As illustrated in FIG. 10 and FIG. 11, the first pressing portion 425 and the second pressing portion 426 are symmetrically disposed with respect to the rotation axis A×1 of the movable member 7.

The first armature 43 and the second armature 44 each have a substantially rectangular shape that is long in the coil axis direction. The first armature 43 is attached to a top surface of the first plate 421. The second armature 44 is attached to a bottom surface of the second plate 422. The first armature 43 and the second armature 44 are disposed in parallel to each other. The first armature 43 and the second armature 44 are formed of, for example, a semi-hard magnetic material. However, the first armature 43 and the second armature 44 may be formed of a material different from a semi-hard magnetic material.

The permanent magnet 45 is disposed between the first armature 43 and the second armature 44. The permanent magnet 45 is disposed so as to overlap the rotation axis A×1 when viewed from a rotation axis A×1 direction. The permanent magnet 45 has a long and narrow shape in the rotation axis direction, that is, in the longitudinal direction of the coil 11.

The movable member 7 includes a first recess 46 and a second recess 47. The first recess 46 and the second recess 47 extend along the coil axis direction. The second recess 47 is provided on an opposite side of the first recess 46 with respect to the rotation axis A×1. The first recess 46 and the second recess 47 are formed by the first armature 43, the permanent magnet 45, and the second armature 44. The above-described first yoke 15 is disposed within the first recess 46. The second yoke 17 is disposed within the second recess 47.

Next, an operation of the relay 1 according to one or more embodiments will be described. When the movable member 7 is in the second state illustrated in FIG. 11, the first pressing portion 425 is separated from the plurality of first movable touch pieces 32, and does not press the first movable touch pieces 32. Also, the second pressing portion 426 is separated from the plurality of second movable touch pieces 36, and does not press the second movable touch pieces 36. Therefore, the first contacts 321 are separated from the first substrate side contact points 31. In addition, the second contacts 361 are separated from the second substrate side contact points 35. Therefore, there is no continuity between the plurality of first terminal portions 33 and the plurality of second terminal portions 34. Also, there is no continuity between the plurality of third terminal portions 37 and the plurality of fourth terminal portions 38.

When the coil block 2 causes the movable member 7 to rotate in a predetermined direction, that is, counterclockwise in FIG. 11, by energization of the coil 11, the movable member 7 is switched from the second state illustrated in FIG. 11 to the first state illustrated in FIG. 10.

As illustrated in FIG. 10, when the movable member 7 is in the first state, the first pressing portion 425 presses the plurality of first movable touch pieces 32 against elastic force of the plurality of first movable touch pieces 32. Thus, the first pressing portion 425 brings the plurality of first contacts 321 into contact with the first substrate side contact points 31. This brings the plurality of first terminal portions 33 and the plurality of second terminal portions 34 into continuity. Also, the second pressing portion 426 presses the plurality of second movable touch pieces 36 against elastic force of the plurality of second movable touch pieces 36. Thus, the second pressing portion 426 brings the plurality of second contacts 361 into contact with the second substrate side contact points 35. This brings the plurality of third terminal portions 37 and the plurality of fourth terminal portions 38 into continuity. Note that when the movable member 7 is in the first state, even if energization of the coil 11 is canceled, the movable member 7 is maintained in the first state by magnetic force of the permanent magnet 45.

When the coil block 2 causes the movable member 7 to rotate in a direction opposite to the above-described predetermined direction, that is, clockwise in FIG. 10, by switching of an energization direction of the coil 11, the movable member 7 is switched from the first state illustrated in FIG. 10 to the second state illustrated in FIG. 11. As illustrated in FIG. 11, when the movable member 7 is in the second state, the first pressing portion 425 is separated from the plurality of first movable touch pieces 32, and the second pressing portion 426 is separated from the plurality of second movable touch pieces 36. Accordingly, the first movable touch pieces 32 return to a natural state by elastic force of the first movable touch pieces 32, and whereby the first contacts 321 are separated from the first substrate side contact points 31. This brings the plurality of first terminal portions 33 and the plurality of second terminal portions 34 into non-continuity. In addition, the second movable touch pieces 36 return to a natural state by elastic force of the second movable touch pieces 36, and whereby the second contacts 361 are separated from the second substrate side contact points 35. This brings the plurality of third terminal portions 37 and the plurality of fourth terminal portions 38 into non-continuity. Note that when the movable member 7 is in the second state, even if energization of the coil 11 is canceled, the movable member 7 is maintained in the second state by magnetic force of the permanent magnet 45.

Note that by cancellation of energization of the coil 11, the movable member 7 may be pushed back by elastic force of the first movable touch pieces 32 and the second movable touch pieces 36, thereby switching the movable member 7 from the first state to the second state.

In the above-described relay 1 according to one or more embodiments, the plurality of first substrate side contact points 31 and the plurality of first movable touch pieces 32 can be arranged side by side within a length range in the coil axis direction of the coil 11. In addition, the plurality of second substrate side contact points 35 and the plurality of second movable touch pieces 36 can be arranged side by side within the length range in the axial direction of the coil 11. Therefore, as the length of the coil 11 increases, the number of substrate side contact points 31 and 35 and movable touch pieces 32 and 36 can be increased.

In a case of increasing the number of substrate side contact points 31 and 35 and movable touch pieces 32 and 36, even if the length in the coil axis direction increases, increase in size in other directions can be inhibited. Therefore, the relay 1 can be arranged in a narrow gap on a substrate on which the relay 1 is mounted. Therefore, a narrow space on the substrate on which the relay 1 is mounted can be effectively used, and layout of the relay 1 is easy.

Since the first base substrate 3 and the second base substrate 4 are disposed to face each other, a mounting area of the relay 1 can be reduced.

By changing pattern arrangement of the first base substrate 3 and the second base substrate 4, the number of plurality of terminal portions 33, 34, 37, and 38 and a connection relationship of the terminal portions 33, 34, 37, and 38 can be changed. In addition, since the terminal portions 33, 34, 37, and 38 are arranged side by side in the coil axis direction, the number of plurality of terminal portions 33, 34, 37, and 38 and the connection relationship of the terminal portions 33, 34, 37, and 38 can be changed easily without complicated pattern wiring.

Figure 13:
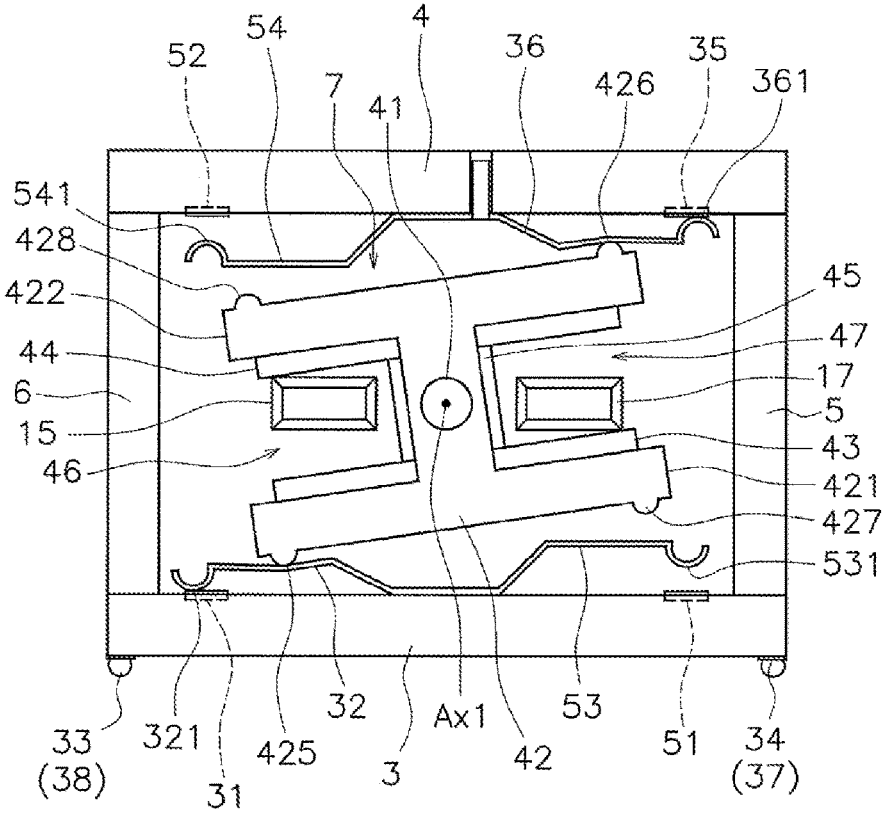
FIG. 13 is a view illustrating a movable member and surrounding structure thereof according to a second embodiment.
Figure 14:
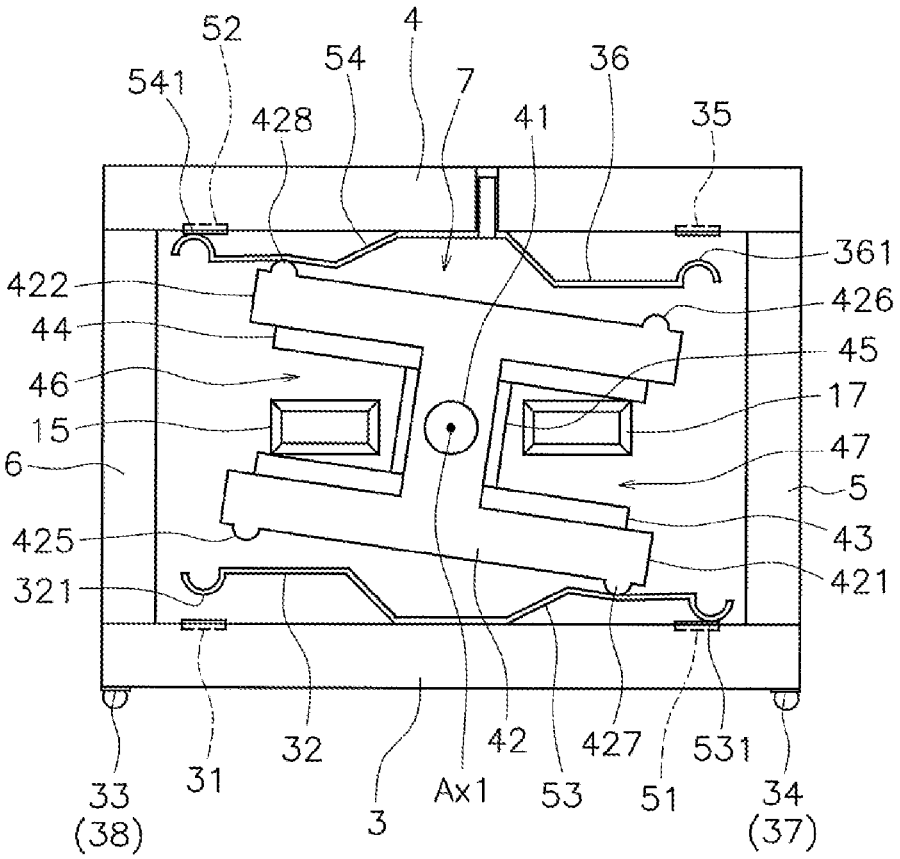
FIG. 14 is a view illustrating a movable member and surrounding structure thereof according to a second embodiment.

Next, a relay 1 according to a second embodiment will be described. FIG. 13 and FIG. 14 are views illustrating a movable member 7 and surrounding structure thereof according to a second embodiment. FIG. 13 illustrates the movable member 7 of a first state. FIG. 14 illustrates the movable member 7 of a second state. As illustrated in FIG. 13 and FIG. 14, in a second embodiment, in addition to a plurality of first substrate side contact points 31, a first base substrate 3 includes a plurality of third substrate side contact points 51. In addition to a plurality of second substrate side contact points 35, a second base substrate 4 includes a plurality of fourth substrate side contact points 52. In addition, a plurality of third movable touch pieces 53 is attached to the first base substrate 3. A plurality of fourth movable touch pieces 54 is attached to the second base substrate 4.

Figure 15:
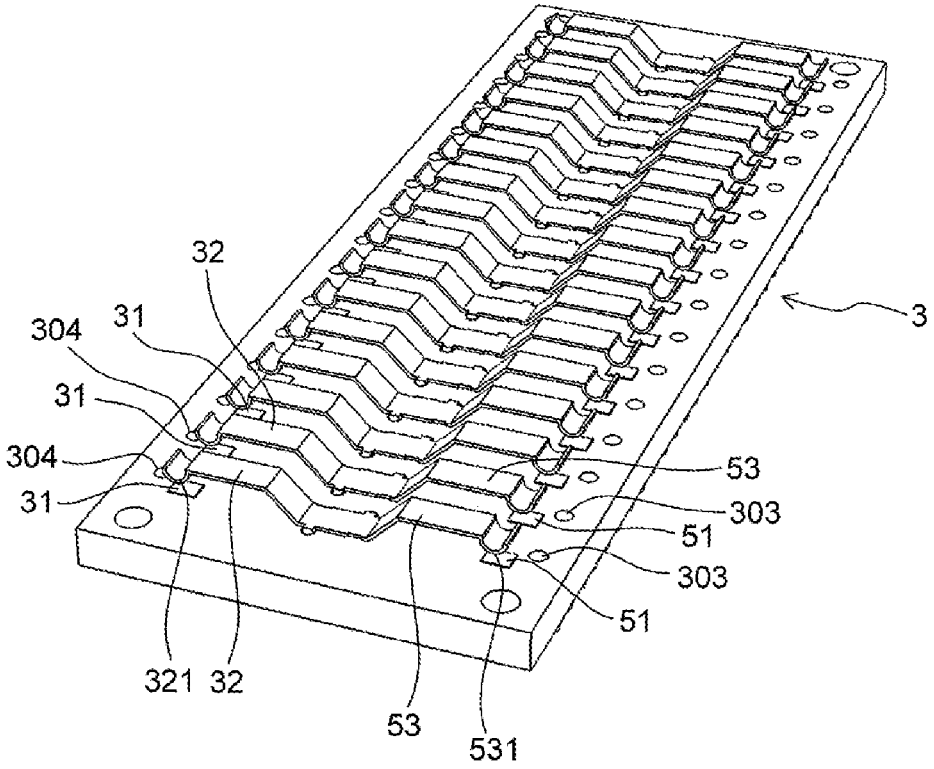
FIG. 15 is a perspective view of a first base substrate according to a second embodiment.

FIG. 15 is a perspective view of the first base substrate 3 according to a second embodiment. As illustrated in FIG. 15, the plurality of third substrate side contact points 51 is arranged side by side in a longitudinal direction of the first base substrate 3, that is, in a coil axis direction on a top surface of the first base substrate 3. The plurality of third substrate side contact points 51 is electrically connected to second terminal portions 34.

The plurality of third movable touch pieces 53 is arranged side by side in the longitudinal direction of the first base substrate 3, that is, in the coil axis direction. The plurality of third movable touch pieces 53 includes third contacts 531 arranged to face the third substrate side contact points 51. The third movable touch pieces 53 are connected to the first movable touch pieces 32, and are electrically connected to unillustrated first common terminal portions provided in the first base substrate 3 together with the first movable touch pieces 32.

Note that the first movable touch piece 32 and the third movable touch piece 53 may be integrally formed. Alternatively, the first movable touch piece 32 and the third movable touch piece 53 may be formed as different bodies.

Figure 16:
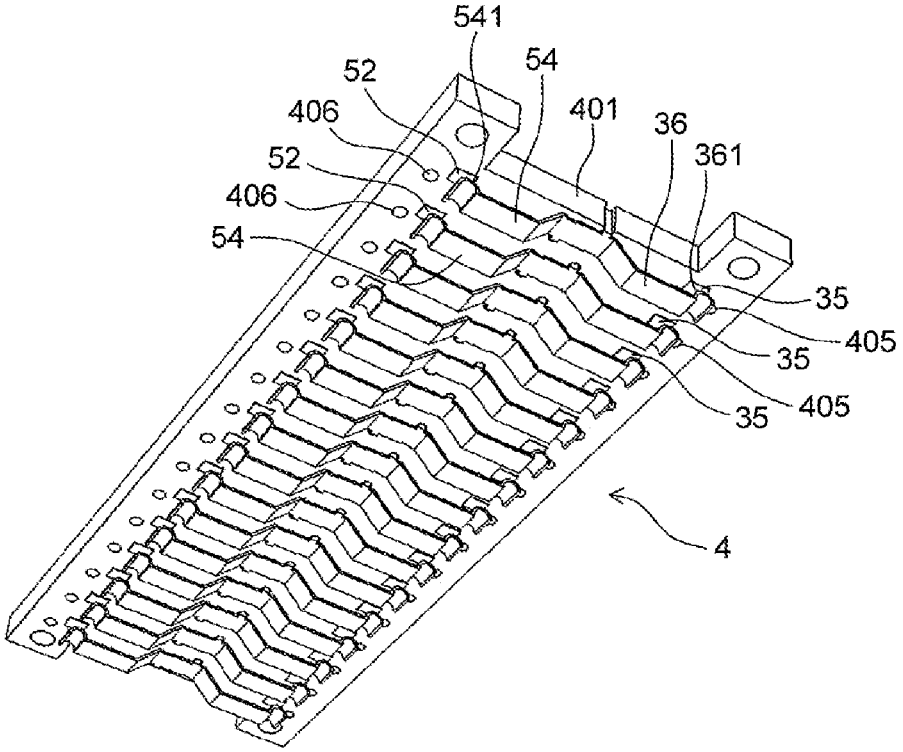
FIG. 16 is a perspective view of a second base substrate according to a second embodiment.
Figure 17:
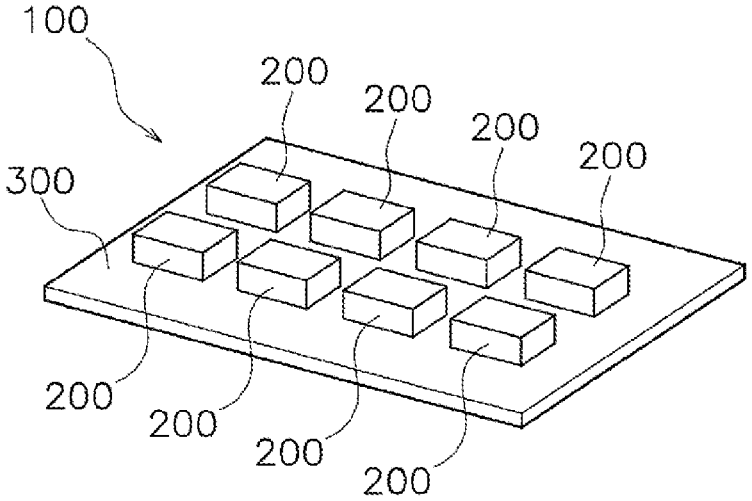
FIG. 17 is a perspective view of a relay module according to a related art.

FIG. 16 is a perspective view of the second base substrate 4 according to a second embodiment. As illustrated in FIG. 16, the plurality of fourth substrate side contact points 52 is arranged side by side in a longitudinal direction of the second base substrate 4, that is, in the coil axis direction. The plurality of fourth substrate side contact points 52 is electrically connected to fourth terminal portions 38 of a first embodiment.

The plurality of fourth movable touch pieces 54 is arranged side by side in the longitudinal direction of the second base substrate 4, that is, in the coil axis direction. The plurality of fourth movable touch pieces 54 includes fourth contacts 541 arranged to face the fourth substrate side contact points 52.

The fourth movable touch pieces 54 are connected to second movable touch pieces 36, and are electrically connected to unillustrated second common terminal portions provided in the second base substrate 4 together with the second movable touch pieces 36.

Note that the second movable touch piece 36 and the fourth movable touch piece 54 may be integrally formed. Alternatively, the second movable touch piece 36 and the fourth movable touch piece 54 may be formed as different bodies.

As illustrated in FIG. 13 and FIG. 14, the plurality of third substrate side contact points 51 is arranged opposite to the plurality of first substrate side contact points 31 with respect to a rotation axis A×1 on the first base substrate 3. That is, the plurality of third substrate side contact points 51 and the plurality of first substrate side contact points 31 are symmetrically arranged with respect to a plane that is perpendicular to the first base substrate 3 and includes the rotation axis A×1. The plurality of fourth substrate side contact points 52 is arranged opposite to the plurality of second substrate side contact points 35 with respect to the rotation axis A×1 on the second base substrate 4. That is, the plurality of fourth substrate side contact points 52 and the plurality of second substrate side contact points 35 are symmetrically arranged with respect to the plane that is perpendicular to the first base substrate 3 and includes the rotation axis A×1.

In addition to a first pressing portion 425 and a second pressing portion 426 described above, the movable member 7 includes a third pressing portion 427 and a fourth pressing portion 428. The third pressing portion 427 is disposed to face the plurality of third movable touch pieces 53. The fourth pressing portion 428 is disposed to face the plurality of fourth movable touch pieces 54.

Next, an operation of the relay 1 according to a second embodiment will be described. When the movable member 7 is in the second state illustrated in FIG. 14, the first pressing portion 425 is separated from the plurality of first movable touch pieces 32, and does not press the first movable touch pieces 32. The second pressing portion 426 is separated from the plurality of second movable touch pieces 36, and does not press the second movable touch pieces 36. Therefore, first contacts 321 are separated from the first substrate side contact points 31. In addition, second contacts 361 are separated from the second substrate side contact points 35.

In addition, when the movable member 7 is in the second state, the third pressing portion 427 presses the plurality of third movable touch pieces 53 against elastic force of the plurality of third movable touch pieces 53. Thus, the third pressing portion 427 brings the plurality of third contacts 531 into contact with the third substrate side contact points 51. In addition, the fourth pressing portion 428 presses the plurality of fourth movable touch pieces 54 against elastic force of the plurality of fourth movable touch pieces 54. Thus, the fourth pressing portion 428 brings the plurality of fourth contacts 541 into contact with the fourth substrate side contact points 52.

Therefore, when the movable member 7 is in the second state, there is continuity between the plurality of second terminal portions 34 and the first common terminal portions, whereas there is no continuity between a plurality of first terminal portions 33 and the first common terminal portions. In addition, there is continuity between the plurality of fourth terminal portions 38 and the second common terminal portions, whereas there is no continuity between a plurality of third terminal portions 37 and the second common terminal portion.

When the coil block 2 causes the movable member 7 to rotate in a predetermined direction, that is, counterclockwise in FIG. 14, by energization of a coil 11, the movable member 7 is switched from the second state illustrated in FIG. 14 to the first state illustrated in FIG. 13. As illustrated in FIG. 13, when the movable member 7 is in the first state, the first pressing portion 425 presses the plurality of first movable touch pieces 32 against elastic force of the plurality of first movable touch pieces 32. Thus, the first pressing portion 425 brings the plurality of first contacts 321 into contact with the first substrate side contact points 31. The second pressing portion 426 presses the plurality of second movable touch pieces 36 against elastic force of the plurality of second movable touch pieces 36. Thus, the second pressing portion 426 brings the plurality of second contacts 361 into contact with the second substrate side contact points 35.

In addition, when the movable member 7 is in the first state, the third pressing portion 427 is separated from the plurality of third movable touch pieces 53, whereas the fourth pressing portion 428 is separated from the plurality of fourth movable touch pieces 54. Accordingly, the third movable touch pieces 53 return to a natural state by elastic force of the third movable touch pieces 53, and whereby the third contacts 531 are separated from the third substrate side contact points 51. In addition, the fourth movable touch pieces 54 return to a natural state by elastic force of the fourth movable touch pieces 54, and whereby the fourth contacts 541 are separated from the fourth substrate side contact points 52.

This brings the plurality of first terminal portions 33 and the first common terminal portions into continuity, whereas this brings the plurality of second terminal portions 34 and the first common terminal portions into non-continuity. This brings the plurality of third terminal portions 37 and the second common terminal portions into continuity, whereas this brings the plurality of fourth terminal portions 38 and the second common terminal portions into non-continuity. Note that when the movable member 7 is in the first state, even if energization of the coil 11 is canceled, the movable member 7 is maintained in the first state by magnetic force of a permanent magnet 45.

When the coil block 2 causes the movable member 7 to rotate in a direction opposite to the above-described predetermined direction, that is, clockwise in FIG. 13, by switching of an energization direction of the coil 11, the movable member 7 is switched from the first state illustrated in FIG. 13 to the second state illustrated in FIG. 14. As illustrated in FIG. 14, when the movable member 7 is in the second state, the first pressing portion 425 is separated from the plurality of first movable touch pieces 32, whereas the second pressing portion 426 is separated from the plurality of second movable touch pieces 36. Accordingly, the first movable touch pieces 32 return to a natural state by elastic force of the first movable touch pieces 32, and whereby the first contacts 321 are separated from the first substrate side contact points 31. In addition, the second movable touch pieces 36 return to a natural state by elastic force of the second movable touch pieces 36, and whereby the second contacts 361 are separated from the second substrate side contact points 35.

In addition, when the movable member 7 is in the second state, the third pressing portion 427 presses the plurality of third movable touch pieces 53 against elastic force of the plurality of third movable touch pieces 53. Thus, the third pressing portion 427 brings the plurality of third contacts 531 into contact with the third substrate side contact points 51. The fourth pressing portion 428 presses the plurality of fourth movable touch pieces 54 against elastic force of the plurality of fourth movable touch pieces 54. Thus, the fourth pressing portion 428 brings the plurality of fourth contacts 541 into contact with the fourth substrate side contact points 52.

This brings the plurality of first terminal portions 33 and the first common terminal portions into non-continuity, whereas this brings the plurality of second terminal portions 34 and the first common terminal portions into continuity. In addition, this brings the plurality of third terminal portions 37 and the first common terminal portions into non-continuity, whereas this brings the plurality of fourth terminal portions 38 and the first common terminal portions into continuity. Note that when the movable member 7 is in the second state, even if energization of the coil 11 is canceled, the movable member 7 is maintained in the second state by magnetic force of the permanent magnet 45.

The relay 1 according to a second embodiment can also produce effects similar to effects of the relay 1 according to a first embodiment. In addition, the relay 1 according to a second embodiment can form continuity corresponding to a-contact, b-contact, and c-contact. While one or more embodiments have been described above, the present invention is not limited to the above-described one or embodiments, and various changes can be made without departing from the spirit of the invention.

Structure of the coil block 2, the first base substrate 3, the second base substrate 4, the first pattern frame 5, the second pattern frame 6, the movable member 7, and the cover 8 may be changed as appropriate. The second base substrate 4 may be omitted. The first pattern frame 5 and/or the second pattern frame 6 may be omitted.

The number of substrate side contact points and the number of movable touch pieces are not limited to the numbers in the above-described embodiments, and may be changed. The number of terminal portions of the first base substrate 3 is not limited to the number in the above-described embodiments, and may be changed.

Arrangement of the first substrate side contact points 31 and the second substrate side contact points 35 is not limited to arrangement in the above-described embodiments, and may be changed. Arrangement of the third substrate side contact points 51 and the fourth substrate side contact points 52 is not limited to arrangement in the above-described embodiments, and may be changed.

Arrangement of the first movable touch pieces 32 and the second movable touch pieces 36 is not limited to arrangement in the above-described embodiments, and may be changed. Arrangement of the third movable touch pieces 53 and the fourth movable touch pieces 54 is not limited to arrangement in the above-described embodiments, and may be changed. Arrangement of the terminal portions 33, 34, 37, and 38 is not limited to arrangement in the above-described embodiments, and may be changed.

INDUSTRIAL APPLICABILITY

One or more embodiments can provide a relay that is easy to do layout and allows increase in the number of contact poles while inhibiting enlargement.

DESCRIPTION OF SYMBOLS

3 first base substrate
31 first substrate side contact point
32 first movable touch piece
7 movable member
11 coil
2 coil block
4 second base substrate
35 second substrate side contact point
36 second movable touch piece
425 first pressing portion
426 second pressing portion
33 first terminal portion
34 second terminal portion
37 third terminal portion
38 fourth terminal portion
5 first pattern frame
501 first pattern
6 second pattern frame
601 second pattern
51 third substrate side contact point
52 fourth substrate side contact point
53 third movable touch piece
54 fourth movable touch piece
427 third pressing portion
428 fourth pressing portion
46 first recess
47 second recess
13 iron core
15 first yoke
17 second yoke

The invention claimed is:

1. A relay comprising:

a first base substrate;

a plurality of first substrate side contact points arranged on the first base substrate;

a plurality of first movable touch pieces comprising first contacts arranged to face the first substrate side contact points;

a movable member configured to switch, by rotation, between a first state in which the plurality of first movable touch pieces are pressed to bring the first contacts into contact with the first substrate side contact points, and a second state in which the first contacts are separated from the first substrate side contact points; and a coil block comprising a coil, the coil block configured to cause the movable member to rotate by electromagnetic force generated by energization of the coil, a second base substrate spaced apart from the first base substrate in a direction perpendicular to a surface of the first base substrate;

a plurality of second substrate side contact points arranged side by side in an axial direction of the coil on a surface of the second base substrate facing the first base substrate; and a plurality of second movable touch pieces comprising second contacts arranged to face the plurality of second substrate side contact points, the plurality of second movable touch pieces being arranged side by side in the axial direction of the coil, wherein a rotation axis of the movable member is parallel to an axis of the coil, the plurality of first substrate side contact points is arranged side by side in the axial direction of the coil on the first base substrate, the plurality of first movable touch pieces is arranged side by side in the axial direction of the coil, the movable member is disposed between the first movable touch pieces and the second movable touch pieces, and the movable member comprises a first pressing portion disposed to face the plurality of first movable touch pieces, and a second pressing portion disposed to face the plurality of second movable touch pieces.

2. The relay according to claim 1, wherein the coil and the movable member each comprise a longitudinal direction in the axial direction of the coil.

3. The relay according to claim 1, wherein a longitudinal direction of the first base substrate is parallel to the axial direction of the coil.

4. The relay according to claim 1, wherein the first base substrate, the movable member, and the coil block are disposed in a stacked manner in the direction perpendicular to the surface of the first base substrate.

5. The relay according to claim 1, wherein the first pressing portion and the second pressing portion are symmetrically disposed with respect to the rotation axis of the movable member.

6. The relay according to claim 1, wherein the first base substrate comprises a plurality of first terminal portions, a plurality of second terminal portions, and a plurality of third terminal portions, the plurality of first terminal portions are electrically connected to the plurality of first substrate side contact points, the plurality of second terminal portions are electrically connected to the plurality of first movable touch pieces, the relay further comprises a first pattern frame disposed between the first base substrate and the second base substrate, the first pattern frame coupling the first base substrate and the second base substrate, and the first pattern frame comprises a plurality of first patterns that electrically connects the plurality of third terminal portions and the plurality of second substrate side contact points.

7. The relay according to claim 6, wherein the first base substrate comprises a plurality of fourth terminal portions, the relay further comprises a second pattern frame disposed between the first base substrate and the second base substrate, the second pattern frame coupling the first base substrate and the second base substrate, and the second pattern frame comprises a plurality of second patterns that electrically connects the plurality of fourth terminal portions and the plurality of second movable touch pieces.

8. The relay according to claim 7, wherein the first pattern frame and the second pattern frame are spaced apart from each other, and the movable member is disposed between the first pattern frame and the second pattern frame.

9. The relay according to claim 1, further comprising:

a plurality of third substrate side contact points arranged side by side in the axial direction of the coil on the first base substrate;

a plurality of fourth substrate side contact points arranged side by side in the axial direction of the coil on the second base substrate;

a plurality of third movable touch pieces comprising third contacts arranged to face the plurality of third substrate side contact points, the plurality of third movable touch pieces being arranged side by side in the axial direction of the coil; and a plurality of fourth movable touch pieces comprising fourth contacts arranged to face the plurality of fourth substrate side contact points, the plurality of fourth movable touch pieces being arranged side by side in the axial direction of the coil, wherein the movable member comprises:

a third pressing portion disposed to face the plurality of third movable touch pieces; and a fourth pressing portion disposed to face the plurality of fourth movable touch pieces.

10. The relay according to claim 9, wherein the plurality of third substrate side contact points is arranged on an opposite side of the plurality of first substrate side contact points with respect to the rotation axis on the first base substrate, and the plurality of fourth substrate side contact points is arranged on an opposite side of the plurality of second substrate side contact points with respect to the rotation axis on the second base substrate.

11. The relay according to claim 9, wherein the first movable touch pieces and the third movable touch pieces are electrically connected, and the second movable touch pieces and the fourth movable touch pieces are electrically connected.

12. A relay comprising:

a first base substrate;

a plurality of first substrate side contact points arranged on the first base substrate;

a plurality of first movable touch pieces comprising first contacts arranged to face the first substrate side contact points;

a movable member configured to switch, by rotation, between a first state in which the plurality of first movable touch pieces are pressed to bring the first contacts into contact with the first substrate side contact points, and a second state in which the first contacts are separated from the first substrate side contact points; and a coil block comprising a coil, the coil block configured to cause the movable member to rotate by electromagnetic force generated by energization of the coil, wherein a rotation axis of the movable member is parallel to an axis of the coil, the plurality of first substrate side contact points is arranged side by side in an axial direction of the coil on the first base substrate, the plurality of first movable touch pieces is arranged side by side in the axial direction of the coil, the movable member comprises:

a first recess extending along the axial direction of the coil; and a second recess provided on an opposite side of the first recess with respect to the rotation axis, the second recess extending along the axial direction of the coil, the coil block further comprises:

an iron core disposed within the coil, the iron core extending in the axial direction of the coil;

a first yoke disposed within the first recess, the first yoke extending in the axial direction of the coil; and a second yoke disposed within the second recess, the second yoke extending in the axial direction of the coil, the first yoke is connected to one end of the iron core in the axial direction of the coil, and the second yoke is connected to another end of the iron core in the axial direction of the coil.

* * * * *